United States Patent [19]

Craighead et al.

[11] 4,149,912

[45] Apr. 17, 1979

[54] PROCESS FOR TREATING ALUMINUM AND ALUMINUM ALLOY SURFACES

[75] Inventors: Kathryn L. Craighead, Minneapolis; Valdis Mikelsons, Mendota Heights, both of Minn.

[73] Assignee: Minnesota Mining and Manufacturing Company, Saint Paul, Minn.

[21] Appl. No.: 814,314

[22] Filed: Jul. 11, 1977

[51] Int. Cl.[2] ..... C23F 7/06

[52] U.S. Cl. ..... 148/6.3; 148/6.27

[58] Field of Search ..... 148/6.3, 6.27

[56] References Cited

FOREIGN PATENT DOCUMENTS 378566 7/1973 U.S.S.R. ..... 148/6.3

*Primary Examiner*—Ralph S. Kendall

*Attorney, Agent, or Firm*—Cruzan Alexander; Donald M. Sell; Gerald F. Chernivec

[57] ABSTRACT

A process for providing a priming layer of aluminum hydroxyoxide on aluminum and aluminum alloy surfaces comprising treating the surface with a chemical reagent having a solvent action for the naturally-occurring oxides which form on such surfaces until said oxides are dissolved, and contacting said surfaces with steam while a film of the reagent is still present on the metal surface. The priming layer provides for excellent adhesion of subsequent organic coatings to the metal surface.

4 Claims, No Drawings

PROCESS FOR TREATING ALUMINUM AND ALUMINUM ALLOY SURFACES

BACKGROUND OF THE INVENTION

The present invention relates to the formation of priming films on aluminum and aluminum alloy surfaces so as to render such surfaces permanently receptive to subsequent organic coatings.

Because of the weight of aluminum and its corrosion characteristics, aluminum and alloys therewith are being increasingly utilized in commercial, industrial and consumer areas in conjunction with organic coatings, e.g., aluminum siding for dwellings, containers for food and beverages, automobile parts, etc.

Especially in the food container area, use of aluminum alloys has significantly increased because such materials have the high strength necessary for can formation and handling procedures, and can provide an economic advantage over conventional tin plated materials because of their high strength/weight ratio. Furthermore, the use of deep-drawn aluminum cans can be expected to further increase due to the growing concern that undesirable quantities of toxic lead can be introduced into food contents from soldered seams conventionally contained in 3-part steel cans.

In order to protect the aluminum surface from corrosion due to salt or other ingredients, or to provide an aesthetic surface thereto, the surfaces of the aluminum are typically covered with a layer of an organic enamel. In the can industry, it is preferred that the aluminum sheet stock be coated with the organic enamel prior to the formation of the can, which requires a high degree of adhesion between the organic enamel and the aluminum sheeting to thereby prevent delamination during the forming process. To obtain the desired degree of adhesion, particularly in aluminum/magnesium alloys containing a high magnesium concentration therein, the metal surface is typically subjected to a priming treatment.

One such treatment which has achieved commercial significance is the chromate conversion process, wherein trivalent chromium solutions are utilized to impart a priming layer on the aluminum surface. Because of the significant quantities of metal being treated in high speed conversion lines, the concentration of toxic chromate effluents from such a process becomes significant and disposal thereof is increasingly becoming a more serious problem. Therefore, a non-polluting process for replacing the chromate treatment would be extremely desirable.

One primer or conversion coating for aluminum and alloys therewith which is capable of satisfying the stringent adhesion requirements as aforementioned, and which can be produced by a number of non-polluting methods is based on the formation of aluminum hydroxyoxide or boehmite on the metal surface. Such a conversion coating can be formed on the aluminum substrate when the aluminum surface is exposed to boiling water, as is taught in U.S. Pat. Nos. 2,091,419; 2,671,995; and 2,859,148; by utilization of various aqueous solutions of salts, organic amines, or oxidizing agents, as is taught in U.S. Pat. Nos. 3,039,898; 3,210,184; 3,380,860; or by the use of steam, as is taught in U.S. Pat. No. 3,728,164, among others.

The problem with each of these prior art processes is that the treatment times therefor require on the order of minutes to hours to obtain adequate coating thicknesses, whereas the chromate conversion coatings can be formed in times as short as five seconds.

One process which has been disclosed indicates that a hydroxyoxide or boehmite layer can be produced on an aluminum/magnesium alloy surface in as short a time as five seconds, that being U.S. Pat. No. 3,247,026. This process, however, requires a procedure for cleaning the surface of the alloy which lasts at least one minute in duration, in which surface oxides are removed either by mechanical abrasion or by an alkaline etch and desmutting process. Therefore, although the process time for producing the actual hydroxyoxide layer pursuant to steam treatment may be of short duration, the preceding cleaning procedures are much too long for a practical high speed coating operation.

It has now been discovered that a process for forming this boehmite layer on aluminum and aluminum/alloy surfaces is available which requires very short combined cleaning and treatment times, i.e., is adaptable to high speed processing, does not generate toxic waste products, and provides an excellent priming layer for a variety of organic coatings.

SUMMARY OF THE INVENTION

In accordance with the invention, our process for treating aluminum and aluminum/alloy surfaces to provide a priming layer for subsequent application of organic coatings involves the simple steps of:

(a) optionally pre-cleaning and rinsing the metal surface to conventionally remove dirt, grease and other contamination utilizing conventional cleaning processes;

(b) applying a chemical reagent to the metallic surface which has a strong solvent action on the naturally occurring oxide film which such metal surfaces typically contain for a time, at a concentration, and at a temperature sufficient to substantially remove said oxide film; and (c) exposing the metallic surface to saturated steam while the aforementioned chemical reagent is still present on the metallic surface.

DETAILED DESCRIPTION OF THE INVENTION

It is, of course, known that metals such as aluminum and alloys therewith contain an oxide surface thereon, resulting from the metal oxidizing in normal atmospheric environment. This oxide has a very low adhesion itself for organic coatings, and also effectively prevents the buildup of a boehmite or hydroxyoxide coating on the metal surface. For this reason, such barrier oxides must be removed from the metallic surface so as to allow the proper boehmite formation.

Chemical reagents which are suitable for removal of the oxide coating include those compounds which in essence are capable of dissolving aluminum oxides. Solutions of strong bases such as sodium hydroxide or potassium hydroxide are particularly effective because of their capability to rapidly dissolve the naturally occurring oxide film on the metal surface. Solutions of other alkaline reagents, such as amines (e.g., ammonia, ethylamine, ethanolamine, ethylenediamine, etc.) or metal salts (e.g., sodium carbonate, calcium carbonate, magnesium oxide) may also be utilized. In addition, acids such as hydrofluoric acid may be used. Preferably, aqueous solutions of the reagents are utilized, since they are economical and present minimum solvent handling problems.

This chemical reagent dissolves the oxide film on the metallic surface in accordance with the following reactions:

$$Al_2O_3+2OH^-+H_2O\rightarrow 2H_2AlO_3^- \quad (1)$$

in the case of an alkaline reagent, and $$Al_2O_3+6H^+\rightarrow 2Al^{3+}+3H_2O \quad (2)$$

in the case of acidic reagents. Such materials may also mildly etch the underlying aluminum or alloy metal per the following reactions:

$$2Al+2OH^-+4H_2O\rightarrow 2H_2AlO_3^-+3H_2 \quad (3)$$

with an alkaline reagent, and $$2Al+6H^+\rightarrow 2Al^{3+}+3H_2 \quad (4)$$

with an acidic reagent.

If etching does occur, a small amount of the alloying constituents, such as magnesium in high magnesium-containing alloys will remain on the treated surface, such remainder commonly being termed "smut". In the process of our invention, analysis shows that this smut is incorporated into the hydroxyoxide layer subsequently formed, and does not substantially interfere with the adhesion-promoting characteristics of the hydroxyoxide layer. Therefore, smut removal is not normally necessary in our process.

With the barrier oxide layer removed, the bare aluminum metal is now susceptible to hydrolysis by the action of steam, thereby forming a hydroxyoxide film on the aluminum surface in accordance with the following reaction:

$$Al+2H_2O\rightarrow AlOOH+3H_2/2 \quad (5)$$

This reaction may terminate as the hydroxyoxide film becomes sufficiently thick to form a new barrier layer.

One critical and unique feature of the process of the invention is that the aluminum surface must remain covered with a thin layer of the chemical reagent when exposure to the boehmite-forming steam begins. If the chemical reagent utilized to dissolve the barrier oxide layer is removed from the metal surface, such as by rinsing, prior to exposure of the surface to steam, it has been ascertained that an insufficient film of the hydroxyoxide will be formed in an allotted reaction time, i.e., about 10 seconds of exposure to steam, which will therefore result in inadequate adhesion of the organic coating thereto, and high speed processing is therefore not available.

One of the distinct advantages of the inventive process, in addition to the reduced time consumption, is that the chemical reagents utilized and reaction products formed are essentially non-polluting. In accordance with the above reactions, waste products that might be discharged from the process would be $H_2AlO_3^-$ or $Al^{3+}$. Neither of these ions are known to have toxic effects. For discarding the chemical reagents, the solutions can be neutralized to a salt if necessary.

The reagent treatment solution temperatures, concentrations, and the time that the solution is to be in contact with the metal surface prior to application of steam thereto depend on the degree to which the reagent dissolves the aluminum oxide barrier layer. With extremely aggressive reagents such as sodium hydroxide, rapid formation of the hydroxyoxide layer will occur if the solution is applied at room temperature and the surface exposed to steam immediately. Less aggressive reagents may require higher temperatures and longer contact times prior to steaming.

Spray application of the reagents may require temperatures, concentration and contact times different from those for dip procedures, and, at least when utilizing sodium hydroxide, the time for processing individual panels can be reduced considerably if the treatment solution is applied by spraying as opposed to dipping.

To minimize the hydroxyoxide-forming treatment time, the concentration level of the reagent should be optimized. If the reagent concentration is too low, the barrier oxide layer may not be completely removed, and rapid formation of the boehmite layer will be prevented, although elevated temperatures, i.e., above about 50° C., will assist the reagent action. If the reagent concentration is too high, etching of the metal surface may continue during exposure thereof to steam, again preventing effective hydrolysis. Reagent concentrations of from about 0.3 to about 5.0 percent by weight have been found acceptable as a general range, depending on the particular reagent chosen and the treatment temperature utilized. In practice, because of the diversity of aluminum oxide solvents available, the surface is exposed to an aluminum oxide solvent-containing solution for a time, at a concentration, and at a temperature sufficient to allow for substantially complete removal of the barrier oxide layer.

For the optional initial metal cleaning step, solvent degreasing or conventional spray or soak cleaners, such as mixtures of sodium pyrophosphate, sodium borate and surfactants may be utilized. Generally, the metal is considered clean if water will wet the surface without beading thereon. However, rigorous precleaning is not necessary if the surface is immersed in the aforementioned reagent solutions long enough to remove contaminants. In fact, precleaning in some instances can be entirely omitted.

Following this precleaning, a thorough rinsing of the metal is recommended. However, trace contamination by phosphate or borate ions from the cleaning solution will not inhibit the boehmite formation as is true in other processes, since the chemical reagent in effect will remove surface contaminants still present following a precleaning step.

The process is applicable to high purity aluminum, e.g., Alloy 1100, as well as to aluminum containing alloying components, e.g., Alloys 3003, 5182 and 5352. It is probable that differing alloys may require different treatment conditions for optimum formation of the hydroxyoxide on the metal surface, because high alloy metals probably generate greater smut buildup than the high purity aluminum surfaces.

The invention will now be more specifically defined by the following non-limiting examples, wherein all parts are by weight unless otherwise specified.

EXAMPLE 1

A 14 cm by 15 cm panel of 0.024 cm thick Alloy 5352 (containing approximately 2.5 percent by weight magnesium as the major alloying additive) was cleaned by dipping for one minute in a solution consisting of 95 grams sodium borate, 95 grams sodium pyrophosphate, 6.0 grams Maprofix NEU, tradename for sodium lauryl sulfate surfactant commercially available from Onyx Chemical, 2.0 grams Ultrawet DS, tradename for sodium linear alkylate sulfonate, a surfactant commercially available form Arco Chemical, 2.0 grams Igepal CO 730, tradename for nonylphenoxypoly(ethyleneoxy) ethanol, a surfactant commercially available from the GAF Corp., and 4000 ml deionized water at 70° C. After cleaning, the panel was rinsed by spraying with deionized water at room temperature for 10 seconds and was then dipped for 5 seconds in a 2.5% solution of NaOH in water at 50° C. The excess liquid was drained from the aluminum surface for 5 seconds and the panel immersed in a chamber containing steam at 92° C. After 10 seconds of exposure to steam the panel was withdrawn, rinsed with deionized water and dried with a jet of warm air.

The effectiveness of this treatment for improving the adhesion of organic coatings was tested by the following procedure, which is useful for non-brittle coatings. The primed surface was coated with a vinyl-epoxy lacquer, DAV 210, commercially available from the Mobil Chemical Co. using a No. 30 Meyer bar. After drying in air at room temperature, the coated panel was cured for 105 seconds at 210° C., cooled and cut into 5 cm by 15 cm strips. The thickness of the cured lacquer layer was about $1.8\times10^{-3}$ cm. To test the adhesion of the coating, each strip was bent to a sharp crease, and 3M Brand No. 610 high tack tape was applied over the bend area and peeled back at a 180° angle. The width of the zone from which the lacquer was removed by the tape was then measured starting from the bend area. The adhesion of the lacquer has an acceptable level if the failure zone is less than 0.08 cm wide. In this case, the zone was 0.04 cm wide, i.e., the lacquer adhesion was good.

EXAMPLE 2

Panels of 0.024 cm thick Alloy 5352 aluminum alloy were cleaned and rinsed as described in Example 1, then dipped in various aqueous reagent solutions for 5 seconds, drained for 5 seconds and exposed to steam at 92° C. for 10 seconds. After the steam treatment the panels were rinsed with deionized water, dried, and coated with the lacquer and tested as described in Example 1. The results are shown in Table 1.

Table 1

| Chemical Reagent | Concentration % by Weight | Solution pH | Treatment Temp ° C. | Max Lacquer Peel-back (cm) |
|---|---|---|---|---|
| KOH | 3.5 | — | 50 | .08 |
| MgO | saturated | 10.3 | 72 | .04 |
| $NH_4OH$ | 2.0 | 11.4 | 80 | .04 |
| $NH_2EtOH$ | 3.0 | 11.7 | 86 | .04 |
| $CaCO_3$ | saturated | 9.1 | 100 | .08 |
| $Na_2CO_3$ | .5 | 11.3 | 85 | .08 |
| $EtNH_2$ | .3 | 11.5 | 90 | .08 |
| $(HOEt)_3N$ | .1 | 9.5 | 91 | .04 |
| HF | 5.0 | — | 50 | .08 |

The adhesion of the lacquer to all samples was therefore acceptable.

EXAMPLE 3

In a series of experiments Alloy 5352 panels were cleaned and rinsed using the procedure described in Example 1, then dipped for 5 sec. in a solution of NaOH in water at 50° C. The concentration of the NaOH solution was varied over a wide range, i.e., from 0.16% to 10%. After draining the excess solution from the surface for 5 sec. the panels were exposed to steam at 92° C. for 10 sec., rinsed with deionized water, dried, coated with lacquer and tested as described in Example 1. The results are illustrated in Table 2.

Table 2

| Concentration of NaOH (% by Weight) | Max Lacquer Peel-back (cm) | Remarks |
|---|---|---|
| 0 | .2 | panel dipped in deionized water |
| .16 | .2 | |
| .32 | .08 | |
| .63 | .04 | |
| 1.25 | .04 | |
| 2.50 | .04 | |
| 5.0 | .04 | |
| 10.0 | .32 | |

The above results show that NaOH solutions in the concentration range between 0.32% and 5.0% provide acceptable lacquer adhesion.

EXAMPLE 4

A 7.5 cm by 15 cm panel of 0.024 cm thick Alloy 5352 aluminum foil was cleaned by dipping in a 0.7 percent by weight solution of NaOH at 82° C. for 30 seconds, rinsed for 15 seconds with deionized water, dipped in 20 percent by weight nitric acid for 30 seconds, and rinsed for 18 seconds with deionized water. The panel was then dipped for 2 seconds in a 2 percent by weight solution of NaOH at 50° C., drained for 10 seconds and immersed in a chamber containing steam at 92° C. After 10 seconds of exposure to steam the panel was withdrawn, rinsed with deionized water and dried with a jet of warm air. Lacquer adhesion was tested as described in Example 1. The lacquer failure zone was 0.04 cm wide, i.e., the adhesion was acceptable.

EXAMPLE 5

In this example, the aluminum panel was passed through a series of spray chambers in a semi-automatic treatment apparatus. A 20 cm by 25 cm panel of 0.024 cm thick Alloy 5352 aluminum foil was cleaned by spraying for 10 seconds with a solution consisting of 120 grams sodium pyrophosphate, 12 grams sodium gluconate, 3 grams Pluronic L-61, tadename for ethylene oxide condensate polyol surfactant commercially available from BASF Wyandotte and 4000 ml deionized water at 68° C. The panel was rinsed for 10 seconds by spraying with deionized water at room temperature, sprayed for 4 seconds with a fine mist of a 2.5 percent by weight solution of NaOH in deionized water and immediately passed into a chamber filled with steam at 90° C. After 5 seconds of exposure to steam the panel was passed into a spray rinse chamber for 10 seconds and was dried with a jet of warm air. The panel was coated with lacquer and tested for adhesion as described in Example 1. The width of the lacquer failure zone was acceptable at 0.04 cm.

EXAMPLE 6

A 7.5 cm by 15 cm panel of 0.024 cm thick Alloy 5352 aluminum foil was cleaned by wiping with ispropyl alcohol. The panel was then dipped for 5 seconds in a 2 percent by weight solution of NaOH at 50° C., drained for 10 seconds and immersed in a chamber containing steam at 90° C. After 10 seconds of exposure to steam the panel was withdrawn, rinsed with deionized water and dried with a jet of warm air. Lacquer adhesion was tested as described in Example 1. The width of the lacquer failure zone was acceptable at 0.04 cm.

EXAMPLE 7

This example illustrates the insensitivity of our process to contamination by phosphate and borate ions.

A panel of Alloy 5352 aluminum foil was cleaned as described in Example 6, then dipped for 5 sec. in a 50° C. solution, consisting of 980 ml deionized water, 20 grams NaOH and 5 ml of an aqueous solution containing 2.26 percent sodium borate, 2.26 percent sodium pyrophosphate, 4 percent Maprofix NEU, 0.048 percent Ultrawet DS and 0.048 percent Igepal CO 730 by weight. After withdrawing and draining for 10 seconds, the panel was rinsed, dried and coated with lacquer and tested for adhesion as described in Example 1. There was no failure of the lacquer coating, indicating excellent adhesion.

EXAMPLE 8

A 14 cm by 15 cm panel of 0.024 cm thick Alloy 5352 aluminum foil as cleaned and rinsed as in Example 1. The panel was then dipped for 5 seconds in a 2.5 percent solution of NaOH in water at 50° C. The excess liquid was drained from the surface for 5 seconds and then rinsed off by spraying with deionized water at room temperature for 10 seconds. While still wet with the water, the panel was immersed in a chamber containing steam at 92° C. for 10 seconds, withdrawn, rinsed with deionized water and dried with a jet of warm air. Lacquer adhesion was tested as described in Example 1. The width of the failure was a 0.32 cm indicating poor, unacceptable lacquer adhesion.

This illustrates that even though a film of water wetted the metal surface, the lack of chemical reagent on the surface resulted in unacceptable adhesion.

EXAMPLE 9

A panel of 0.024 cm thick Alloy 5352 aluminum with mill finish was immersed in an aqueous 2 percent by weight solution of NaOH at 22° C. until uniform gas evolution occurred over the surface of the sample, taking approximately 20 seconds. The panel was then withdrawn from the solution, excess liquid drained off and the sample exposed to steam for 7 seconds. The panel was then rinsed, coated with lacquer and tested for adhesion as described in Example 1. There was no failure of the lacquer coating, indicating excellent adhesion.

This example illustrates that precleaning of the panel was not necessary.

EXAMPLE 10

Panels of aluminum Alloys, 1100, 3003, 5182, and 5352 were cleaned, treated with 2.5 percent NaOH solution, exposed to steam, coated with lacquer and tested for adhesion as described in Example 1. The adhesion test results are summarized in Table 3.

Table 3

| Alloy | Major Alloying Impurity | Sample Thickness (cm) | Max. Lacquer Peel-back (cm) | Comments |
|---|---|---|---|---|
| 1100 | none (99+% Al) | .02 | 0 | excellent adhesion |
| 3003 | 1.2% Mn | .02 | 0 | excellent adhesion |
| 5182 | 4–5% Mg | .028 | .04 | acceptable adhesion |
| 5352 | 2.5% Mg | .025 | .04 | acceptable adhesion |

These results illustrate that acceptable lacquer adhesion can be achieved to very pure aluminum as well as to high magnesium content alloys by subjecting the metal surface to our treatment process.

EXAMPLE 11

Four panels of Alloy 1100 aluminum were cleaned and rinsed as described in Example 1. Two of the panels were treated with NaOH and exposed to steam as provided in Example 1.

Two relatively brittle coatings were then applied to one untreated and one treated aluminum surface. The first coating was Kel F-827, tradename for a copolymer of chlorotrifluoroethylene and vinylidene fluoride, which was applied usng a No. 30 Meyer bar from a 5 percent by weight solution in methyl ethyl ketone, air dried for 15 minutes and cured for 20 minutes at 60° C. The second coating was ethyl cellulose, which was applied with a No. 30 Meyer bar from a 10 percent by weight xylene/ethanol solution (9:1 by weight ratio), air dried for 60 minutes and cured at 60° C. for 15 minutes.

In this instance, because of the relative brittleness of the coatings, adhesion was tested by scratching the coating in a straight line and pulling 3M Brand No. 610 tape across the scratch area. The degree of adhesion is summarized in Table 4.

Table 4

| Sample Treatment | Coating | Peel-back (cm) |
|---|---|---|
| clean only | Kel F | 5.0 |
| clean only | ethyl cellulose | 5.0 |
| NaOH/steam | Kel F | 0 |
| NaOH/steam | ethyl cellulose | 0.3 |

These results clearly illustrate the improved adhesion resulting from the process of our invention.

What is claimed is:

1. A high speed process for providing a hydrated oxide coating on the surface of aluminum and aluminum alloys comprising the steps of:
   (a) treating said surface with a chemical reagent capable of dissolving aluminum oxide for a time, in an amount, and at a temperature sufficient to substantially remove all of said aluminum oxide from said surface; and
   (b) without removing said chemical reagent from said surface, exposing said surface to saturated steam for several seconds to provide in situ formation of a hydrated oxide on said surface.

2. The process of claim 1 wherein said chemical reagent comprises sodium hydroxide.

3. A high speed process for providing a hydrated oxide coating on the surface of aluminum and aluminum alloys comprising the steps of:
   (a) precleaning said surface;
   (b) treating said surface with a chemical reagent capable of dissolving aluminum oxide for a time, in an amount, and at a temperature sufficient to substantially remove all of said aluminum oxide from said surface; and
   (c) without removing said chemical reagent from said surface, exposing said surface to saturated steam for several seconds to provide in situ formation of a hydrated oxide on said surface.

4. The process of claim 3 wherein said chemical reagent comprises sodium hydroxide.

* * * * *